US008230825B2

(12) United States Patent
Knorr, Jr.

(10) Patent No.: US 8,230,825 B2
(45) Date of Patent: Jul. 31, 2012

(54) BOILER CONTROL SYSTEM

(76) Inventor: Warren G. Knorr, Jr., Newark, OH (US)

( * ) Notice: Subject to any disclaimer, the term of this patent is extended or adjusted under 35 U.S.C. 154(b) by 1036 days.

(21) Appl. No.: 12/045,294

(22) Filed: Mar. 10, 2008

(65) Prior Publication Data

US 2009/0223466 A1 Sep. 10, 2009

(51) Int. Cl.
*F22B 37/42* (2006.01)

(52) U.S. Cl. ..... 122/448.1; 700/274

(58) Field of Classification Search ..... 122/448.1, 122/448.3; 700/274
See application file for complete search history.

(56) References Cited

U.S. PATENT DOCUMENTS

| | | | |
|---|---|---|---|
| 3,549,089 | A | 12/1970 | Hamlett |
| 4,157,238 | A | 6/1979 | van Berkum |
| 4,249,886 | A | 2/1981 | Bush |
| 4,278,052 | A | 7/1981 | Sharp |
| 4,315,730 | A | 2/1982 | Watson |
| 4,362,269 | A | 12/1982 | Rastogi et al. |
| 4,363,440 | A | 12/1982 | Broach |
| 4,474,549 | A | 10/1984 | Capone |
| 4,486,166 | A | 12/1984 | Nelson et al. |
| 4,553,924 | A | 11/1985 | Nelson et al. |
| 4,637,296 | A | 1/1987 | Hirosaki et al. |
| 5,511,971 | A | 4/1996 | Benz et al. |
| 5,570,659 | A | 11/1996 | Cohen |
| 5,678,493 | A | 10/1997 | Kelley et al. |
| RE36,373 | E | 11/1999 | Benz et al. |
| 2007/0250215 | A1 * | 10/2007 | Jia et al. ..... 700/274 |

OTHER PUBLICATIONS

International Searching Authority (USPTO), International Search Report and Written Opinion for International Application No. PCT/US2009/36498 , mailed May 12, 2009, 8 pages.

* cited by examiner

*Primary Examiner* — Gregory A Wilson
(74) *Attorney, Agent, or Firm* — David J. Dawsey; Michael J. Gallagher; Gallagher & Dawsey Co., LPA

(57) ABSTRACT

A boiler control system for efficiently controlling the operation of a packaged boiler is provided. The system includes a combustion air control system, a fuel control system, a flue gas sensing system, and a boiler controller. The boiler controller is in operative communication with the combustion air control system, fuel control system, and the flue gas sensing system. Based upon a system demand, the boiler controller controls coarse-level operation of the combustion air control system and the fuel control system. The flue gas sensing system includes an oxygen sensor and a flue gas differential sensor that senses a change in a characteristic of the flue gas. When the flue gas differential sensor senses a change in the flue gas characteristic that meets a flue gas differential setpoint, the boiler controller controls fine-level operation of the combustion air control system to efficiently control the amount of oxygen in the flue gas.

12 Claims, 6 Drawing Sheets

BOILER CONTROL SYSTEM

TECHNICAL FIELD

The present invention is related to control systems, and more particularly to a boiler control system for efficiently controlling the operation of a boiler.

BACKGROUND OF THE INVENTION

It is well known that the efficiency of a combustion process is related to the air-to-fuel or oxygen-to-fuel ratio. Conventional types of combustion control systems for packaged boilers are typically referred to as positioning control systems. In positioning control systems, the fuel and combustion air controllers, namely the fuel valve and the fan damper, are mechanically interconnected such that a distinct fan damper position is always associated with a particular valve position. The mechanical interconnection is generally a linkage that incorporates some form of cam that has an adjustable shape which is set at the factory and fine-tuned during boiler start-up, or commissioning, by manual adjustment to give optimum conditions over the load range of the boiler.

During boiler operation a sensor measures a process variable related to the system demand and compares it to a predetermined set-point value. A control signal is then sent to an actuator to modulate the fuel and combustion air controllers to achieve the set-point value. The actuator controls the positioning of the linkage. The linkage generally consists of at least one shaft connected to numerous control rods.

It is common practice to operate boilers with 15 to 30 percent more air than is stoichiometrically required for the complete combustion. The amount of excess air should be closely controlled because too much excess air carries usable heat out of the process and too little excess air may cause the boiler to soot or create an explosive condition. Measurement and control of the amount of excess air is one way to achieve efficient boiler performance. A common method for determining the amount of excess air in the combustion process is to measure the oxygen content of the flue gas exiting the boiler stack.

One problem with prior art control systems is that they do not account for the time lag associated with controlling the amount of excess air in the combustion process. Generally, the time lag may be thought of as the time required for the combustion gases to travel from the burner through the boiler to the stack, where the combustion gases are analyzed for oxygen content. At any given time the amount of excess air detected in the flue gas may not be indicative of the combustion process actually occurring at the burner. Thus, making adjustments to the air flow and fuel flow based on inaccurate readings of excess air can result in inefficient boiler operation.

Therefore, there is a need for a boiler control system that efficiently controls the operation of a boiler or other combustion apparatus. Specifically, there is a need for a boiler control system that responds accurately to the system demand and also accounts for the time lag associated with the boiler combustion process to efficiently control the operation of the boiler.

SUMMARY OF THE INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The present invention is a boiler control system for efficiently controlling the operation of a boiler. The boiler control system generally includes a combustion air control system, a fuel control system, a flue gas sensing system, and a boiler controller.

The combustion air control system includes a combustion air fan and a combustion air damper. The combustion air fan supplies combustion air to the boiler, while the combustion air damper regulates the amount of combustion air supplied to the boiler by the combustion air fan. In one embodiment, the combustion air control system may further include an auxiliary combustion air damper to provide additional control of the amount of combustion air supplied to the boiler by the combustion air fan.

The fuel control system includes a burner to supply fuel to the boiler as well as a fuel valve to regulate the amount of fuel supplied to the boiler by the burner. The burner may be a conventional oil or gas fired burner, as well as more specialized burners directed to virtually any combustible liquid or gas. Additionally, the fuel valve may be a standard control valve.

A flue gas sensing system is included to analyze the flue gas exiting the boiler through the stack. The flue gas sensing system includes an oxygen sensor to sense the amount of oxygen in the flue gas. The flue gas sensing system also includes a flue gas differential sensor to sense a change in a predetermined characteristic of the flue gas. Typically, a change in a predetermined characteristic of the flue gas will be associated with either a change in the combustion air control system or a change in the fuel control system. The predetermined characteristic of the flue gas may be any number of process characteristics associated with the flue gas, such as the flue gas temperature, the flue gas flowrate, the flue gas pressure, or the flue gas particulate concentration.

The boiler controller may be a conventional type of controller, such as a programmable logic controller. The boiler controller may be programmed to include a system demand setpoint, a flue gas oxygen setpoint, and a flue gas differential setpoint. To control the efficient operation of the boiler, the boiler controller is in operative communication with the combustion air control system, the fuel control system, the flue gas sensing system, and a system demand sensor.

The boiler controller controls the efficient operation of the boiler by what can be thought of as two separate levels of control. The first level of control may be termed coarse-level control, which generally corresponds to relatively large and somewhat imprecise adjustments. The second level of control may be described as fine-level control, which generally corresponds to relatively small and more accurate adjustments.

The coarse-level control is initiated when the system demand sensor provides a value that deviates from the system demand setpoint. In response, the boiler controller will send output signals to control the coarse-level operation of the combustion air control system and the fuel control system to achieve a system demand value that closely corresponds to the system demand setpoint.

Execution of the fine-level control begins after the flue gas differential sensor has sensed a change in the predetermined characteristic that meets the flue gas differential setpoint. The fine-level control is used to optimize the efficiency of the boiler by maintaining the amount of oxygen in the flue gas at the flue gas oxygen setpoint.

At any given time the amount of oxygen detected in the flue gas may not be indicative of the combustion process occurring at the burner. This is a result of a time lag. Generally, the time lag may be thought of as the time required for the combustion gases to travel from the burner through the boiler and a portion of the boiler stack to the oxygen sensor, plus the time required to analyze the combustion gases for oxygen.

The boiler control system of the instant invention addresses the time lag by controlling fine-level operation of the combustion air control system or the fuel control system only after a change in a predetermined characteristic of the flue gas has been sensed by the flue gas differential sensor. Thus, the boiler control system efficiently controls the operation of the boiler by ensuring that fine-level control of oxygen in the flue gas, or excess air, is based on the combustion conditions occurring at the burner.

The coarse-level operation of the combustion air control system may be achieved via several methods. For example, in one embodiment, the combustion air control system may include a combustion air damper to control the amount of combustion air supplied by the combustion air fan. In another embodiment, the combustion air fan may include a fan speed controller. The fan speed controller varies the speed of the combustion air fan to regulate the amount of combustion air supplied to the boiler.

With regard to the fuel control system, coarse-level operation is accomplished by the fuel valve. The fuel valve may include a valve actuator to adjust the positioning of the fuel valve to increase or decrease fuel flow to the boiler.

To detect the effects of coarse-level changes, the flue gas sensing system includes a flue gas differential sensor to sense a change in a predetermined characteristic of the flue gas that is indicative of coarse-level changes to the combustion air control system and the fuel control system. The changes in the predetermined characteristic of the flue gas are then communicated by the flue gas differential sensor to the boiler controller. If the change sensed by the flue gas differential sensor meets the flue gas differential setpoint, the boiler controller will send output signals to control the fine-level operation of the combustion air control system or the fuel control system to maintain the flue gas oxygen setpoint.

Additionally, in one embodiment, the boiler controller may be programmed to control fine-level operation only when the change in a predetermined characteristic of the flue gas, as measured by the flue gas differential sensor, meets the flue gas differential setpoint and is sustained for a certain amount of time. This embodiment will help ensure that the boiler has reached some degree of steady state operation after coarse-level control before any fine-level control adjustments are made, thereby reducing "hunting" that is commonly experienced by prior art control systems.

The fine-level operation of the combustion air control system may be effected by several methods. For example, in one embodiment, the combustion air control system may include a combustion air damper to control the amount of combustion air supplied to the boiler by the combustion air fan. In another embodiment, the combustion air fan may include a fan speed controller to vary the speed of the combustion air fan in order to regulate the amount of combustion air that is supplied to the boiler to control the amount of oxygen in the flue gas. In yet another embodiment, the combustion air control system may further include an auxiliary combustion air damper to further regulate the amount of combustion air supplied to the boiler.

The instant invention enables a significant advance in the state of the art. The instant invention is, in addition, widely applicable to a large number of applications. Variations, modifications, alternatives, and alterations of the various embodiments may be used alone or in combination with one another, as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

Figure 1:
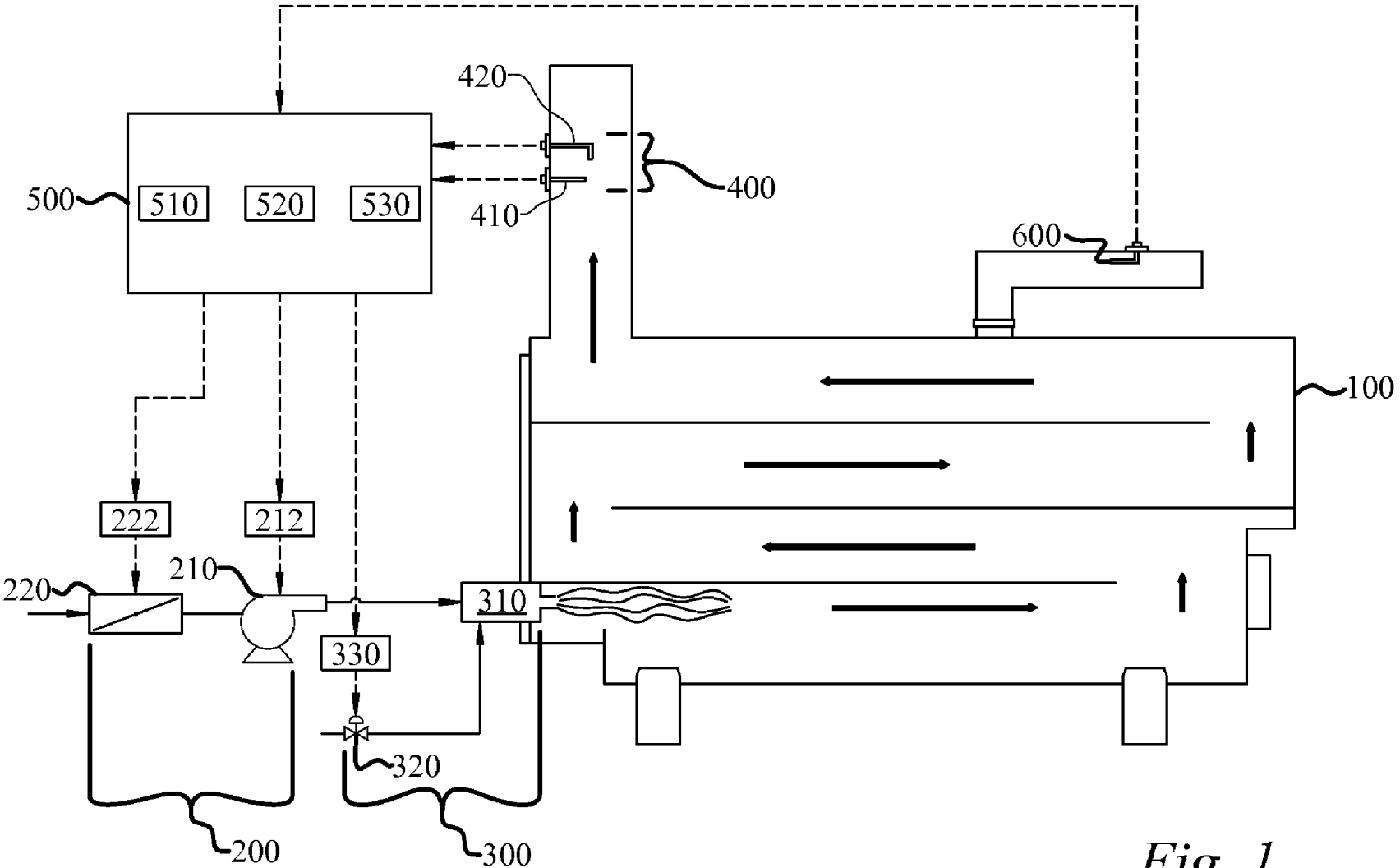
FIG. 1 is a schematic illustrating an embodiment of the boiler control system of the instant invention.

A boiler control system for efficiently controlling the operation of a boiler (100) enables a significant advance in the state of the art. The preferred embodiments of the apparatus accomplish this by new and novel arrangements of elements that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Referring generally to FIGS. 1 through 11, the present invention is a boiler control system for efficiently controlling the operation of a packaged boiler (100). The boiler control system may generally include a combustion air control system (200), a fuel control system (300), a flue gas sensing system (400), and a boiler controller (500).

With reference now to FIG. 1, an embodiment of the boiler control system is illustrated. In this embodiment, the boiler control system is used to control the operation of a boiler (100). The boiler (100) may be used to provide steam, hot water, or other heating fluid at a desired pressure or temperature. By way of example, and not limitation, the boiler (100) may be a fire-tube boiler or a water-tube boiler. However, one with skill in the art would recognize that the boiler control system of the present invention may be used to control the efficient operation of virtually any type of combustion apparatus.

Figure 2:
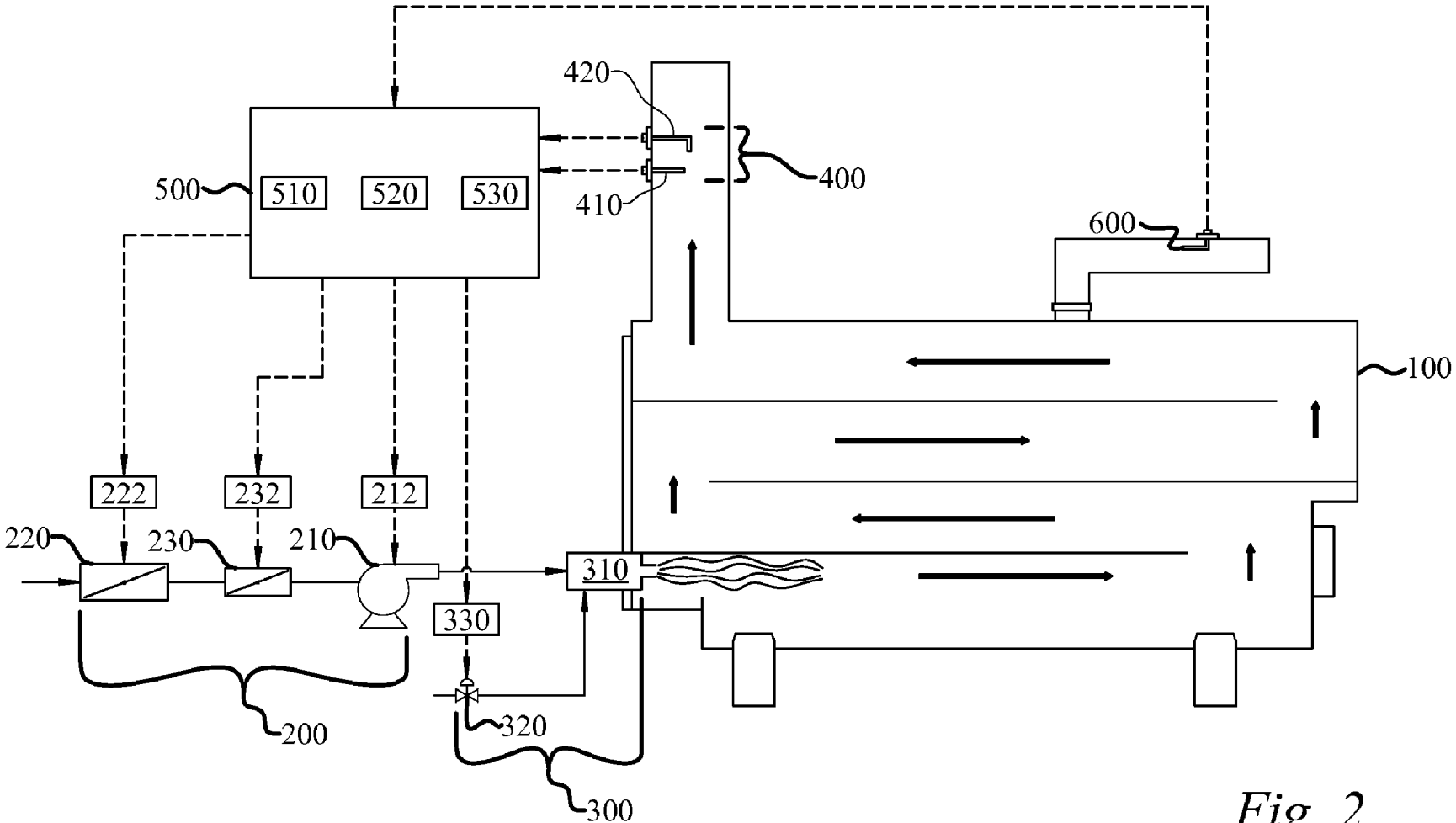
FIG. 2 is a schematic illustrating an embodiment of the boiler control system of the instant invention.

As seen in FIG. 1, the boiler control system includes a combustion air control system (200). The combustion air control system (200) has a combustion air fan (210) and a combustion air damper (220). The combustion air fan (210) supplies combustion air to the boiler (100), while the combustion air damper (220) regulates the amount of combustion air supplied to the boiler (100) by the combustion air fan (210). By way of example, and not limitation, the combustion air fan (210) may be a conventional forced draft fan or a squirrel-cage fan. The combustion air damper (220) may be a register or blade type damper or a radial damper. Additionally, the combustion air control system (200) may include an auxiliary combustion air damper (230) to provide additional control of the amount of combustion air supplied to the boiler (100) by the combustion air fan (210), as seen in FIG. 2.

Still referring to FIG. 1, the boiler control system also includes a fuel control system (300). The fuel control system (300) has a burner (310) to supply fuel to the boiler (100) as well as a fuel valve (320) to regulate the amount of fuel supplied to the boiler (100) by the burner (310). The burner (310) may be a conventional oil or gas fired burner, as well as more specialized burners directed to virtually any combustible liquid or gas. Additionally, the fuel valve (320) may be a standard control valve.

A flue gas sensing system (400) is included to analyze the flue gas exiting the boiler (100) through the stack, as seen in FIG. 1. The flue gas sensing system (400) includes an oxygen sensor (410) to sense the amount of oxygen in the flue gas. The oxygen sensor (410) may be, for example, a zirconium oxide sensor, an electrochemical sensor, or a partial pressure sensor, just to name a few. It is well known that the amount of oxygen measured in the flue gas corresponds to the amount of excess air being used in the combustion process, which correlates to the efficiency of the combustion process. For example, if there is a high level of excess air, energy will be wasted by heating up the air, thus reducing boiler efficiency. On the other hand, if the excess air level is too low the boiler may soot, or explosive conditions may occur. Therefore, to operate the boiler (100) efficiently and safely, the amount of oxygen in the flue gas, or excess air, should be controlled.

As seen in FIG. 1, the flue gas sensing system (400) also includes a flue gas differential sensor (420). The flue gas differential sensor (420) is used to sense a change in a predetermined characteristic of the flue gas. Changes in the predetermined characteristic of the flue gas may be associated with either a change in the combustion air control system (200) or a change in the fuel control system (300). The predetermined characteristic of the flue gas may be any number of process characteristics associated with the flue gas, such as the flue gas temperature, the flue gas flowrate, the flue gas pressure, or the flue gas particulate concentration.

Referring again to FIG. 1, the boiler control system of the present invention includes a boiler controller (500). The boiler controller (500) may be a conventional type of controller, such as a programmable logic controller. The boiler controller (500) may be programmed to include a system demand setpoint (510), a flue gas oxygen setpoint (520), and a flue gas differential setpoint (530). To control the efficient operation of the boiler (100), the boiler controller (500) is in operative communication with the combustion air control system (200), the fuel control system (300), the flue gas sensing system (400), and a system demand sensor (600). The system demand sensor (600) may be, for example, a temperature sensor, pressure sensor, or similar device that measures a process characteristic and communicates that measurement to the boiler controller (500).

The way in which the boiler controller (500) works to achieve the efficient operation of the boiler (100) may be thought of as two separate levels of control. The first level of control may be termed coarse-level control, which generally corresponds to relatively large and somewhat imprecise adjustments. The second level of control may be described as fine-level control, which generally corresponds to relatively small and more accurate adjustments.

Figure 4:
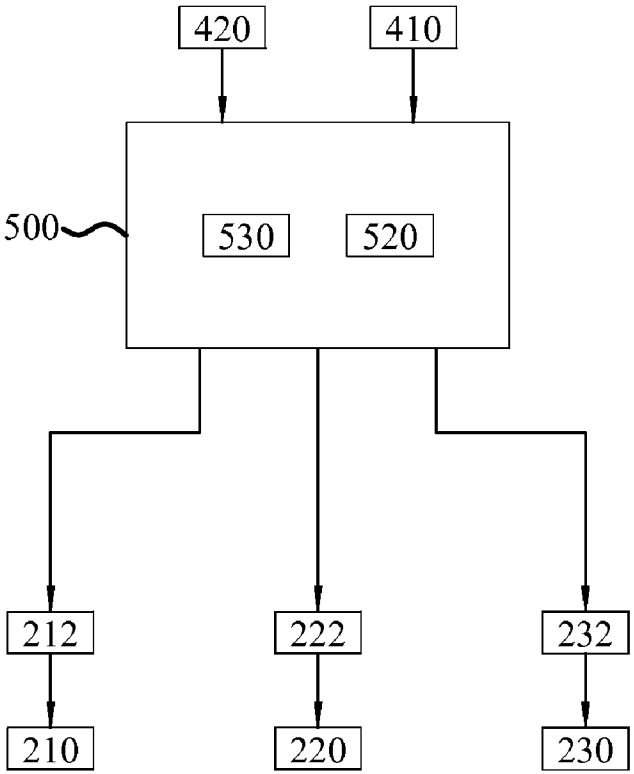
FIG. 4 is a block diagram illustrating an embodiment of fine-level operation of the boiler control system of the instant invention.
Figure 3:
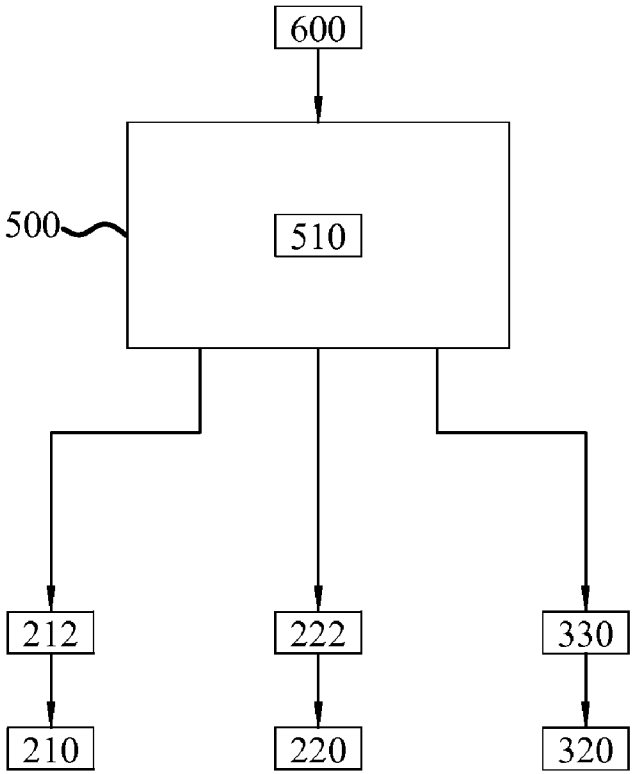
FIG. 3 is a block diagram illustrating an embodiment of coarse-level operation of the boiler control system of the instant invention.

In the instant invention, the boiler controller (500) controls the efficient operation of the boiler (100) by utilizing coarse-level and fine-level controls, as seen in FIGS. 3 and 4, respectively. For example, if the boiler (100) is producing steam at a desired pressure, which in this case would be the system demand setpoint (510), and the downstream steam demand suddenly increases, the steam pressure, as measured by the system demand sensor (600), will drop below the system demand setpoint (510). In response to the system demand setpoint (510), the boiler controller (500) will send output signals to control the coarse-level operation of the combustion air control system (200) and the fuel control system (300) to achieve a steam pressure that closely corresponds to the system demand setpoint (510).

Referring to FIG. 4, the boiler controller (500) executes fine-level control after the flue gas differential sensor (420) has sensed a change in the predetermined characteristic that meets the flue gas differential setpoint (530). The fine-level control is used to optimize the efficiency of the boiler (100) by maintaining the amount of oxygen in the flue gas at the flue gas oxygen setpoint (520). For example, when the flue gas differential setpoint (530) is met, the boiler controller (500) will send output signals to control the fine-level operation of the combustion air control system (200) to adjust the amount of combustion air required to achieve and maintain the flue gas oxygen setpoint (520).

As previously mentioned, the amount of oxygen in the flue gas, or excess air, is an indication of the efficiency of the combustion process occurring at the burner (310). Therefore, maintaining good control of the amount of oxygen in the flue gas will result in a more efficient combustion process. However, at any given time the amount of oxygen detected in the flue gas may not be indicative of the combustion process occurring at the burner (310). This is a result of a time lag. Generally, the time lag may be thought of as the time required for the combustion gases to travel from the burner (310) through the boiler (100) and a portion of the boiler stack to the oxygen sensor (410), plus the time required to analyze the combustion gases for oxygen. The time lag can range from anywhere from 10 seconds to over a minute, and varies from boiler to boiler. For example, in a moderately sized 3-pass fire tube boiler, the combustion gases may need to travel over 30 linear feet to get to the discharge of the boiler. Therefore, adjustments made to the combustion air control system (200) or the fuel control system (300) based only upon the amount of oxygen being sensed by the oxygen sensor (410) will be inaccurate due to the time lag.

The boiler control system of the instant invention addresses the time lag by controlling fine-level operation of the combustion air control system (200) or the fuel control system (300) only after a change in a predetermined characteristic of the flue gas has been sensed by the flue gas differential sensor (420). Thus, the boiler control system efficiently controls the operation of the boiler (100) by ensuring that fine-level control of oxygen in the flue gas, or excess air, is based on the combustion conditions occurring at the burner (310).

Referring to FIG. 1, an embodiment of the boiler control system is shown in diagram form. In operation, the system demand sensor (600) communicates the system demand, such as temperature or pressure, to the boiler controller (500). The boiler controller (500) compares the system demand to the system demand setpoint (510). Based on this comparison, the boiler controller (500) will transmit signals to the combustion air control system (200) and the fuel control system (300) for coarse-level control. For example, if the system demand is based on steam pressure, and the system demand sensor (600) senses a steam pressure below the system demand setpoint (510), the boiler controller (500) will control coarse-level operation of the combustion air control system (200) and the fuel control system (300) in order to supply more combustion air and fuel to the boiler (100). Typically, the boiler controller (510) will be programmed for specific air to fuel ratios at known firing rates to ensure adequate excess air for safe operation.

The coarse-level operation of the combustion air control system (200) may be achieved via several methods. For example, in one embodiment, the combustion air control system (200) may include a combustion air damper (220) to control the amount of combustion air supplied by the combustion air fan (210), as seen in FIG. 1. The combustion air damper (220) may include a damper actuator (222) to control the operation of the combustion air damper (220). The boiler controller (500) may communicate with the damper actuator (222) to control the operation of the combustion air damper (220) to adjust the amount of combustion air supplied to the boiler (100).

In another embodiment, the combustion air fan (210) may include a fan speed controller (212), as seen in FIG. 1. The fan speed controller (212) varies the speed of the combustion air fan (210) to adjust the amount of combustion air supplied to the boiler (100). Thus, the boiler controller (500) may communicate with the fan speed controller (212) to increase or decrease the amount of combustion air supplied by the combustion air fan (210). In one particular embodiment, the fan speed controller (212) is a variable frequency drive.

With regard to the fuel control system (300), coarse-level operation is accomplished by the fuel valve (320). The fuel valve (320) may include a valve actuator (330) to adjust the positioning of the fuel valve (320), as seen in FIG. 1. Depending on the system demand, the boiler controller (500) will communicate with the valve actuator (330) to effect an adjustment of the fuel valve (320) to increase or decrease fuel flow to the boiler (100).

As previously discussed, when coarse-level changes are made to the combustion air control system (200) and the fuel control system (300), there is a time lag between when the coarse-level changes are made and when the effects of the changes reach the flue gas sensing system (400). Therefore, any fine-level changes to control the amount of oxygen in the flue gas should only be made after the effects of the coarse-level change have been sensed by the flue gas sensing system (400).

To detect the effects of coarse-level changes, the flue gas sensing system (400) includes a flue gas differential sensor (420). The flue gas differential sensor (420) may be designed to sense a change in a predetermined characteristic of the flue gas that is indicative of coarse-level changes to the combustion air control system (200) and the fuel control system (300). The changes in the predetermined characteristic of the flue gas are then communicated by the flue gas differential sensor (420) to the boiler controller (500). If the change sensed by the flue gas differential sensor (420) meets the flue gas differential setpoint (530), the boiler controller (500) will send output signals to control the fine-level operation of the combustion air control system (200) or the fuel control system (300) to maintain the flue gas oxygen setpoint (520).

Figure 5:
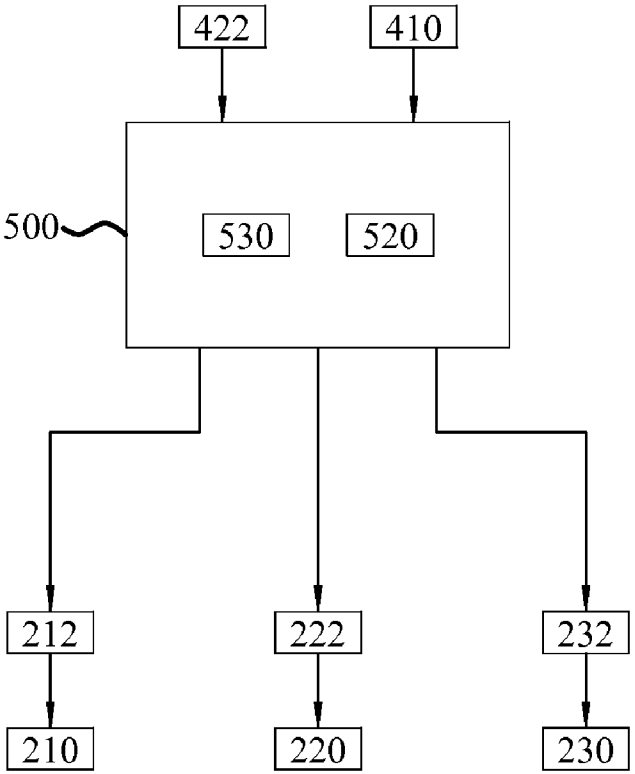
FIG. 5 is a block diagram illustrating an embodiment of fine-level operation of the boiler control system of the instant invention.

In one embodiment, the flue gas differential sensor (420) may be a temperature sensor (422) to measure the temperature of the flue gas, and the flue gas differential setpoint (530) may be a predetermined change in the flue gas temperature, as seen in FIG. 5. By way of example, and not limitation, the temperature sensor (422) may be a thermocouple, thermistor, resistance thermometer, or any other type of appropriate temperature measuring device. In operation, the temperature sensor (422) sends output signals regarding the flue gas temperature to the boiler controller (500), and if there is a change in flue gas temperature that meets the flue gas differential setpoint (530), the boiler controller (500) will send output signals to control the fine-level operation of the combustion air control system (200) or the fuel control system (300) to maintain the flue gas oxygen setpoint (520).

Figure 6:
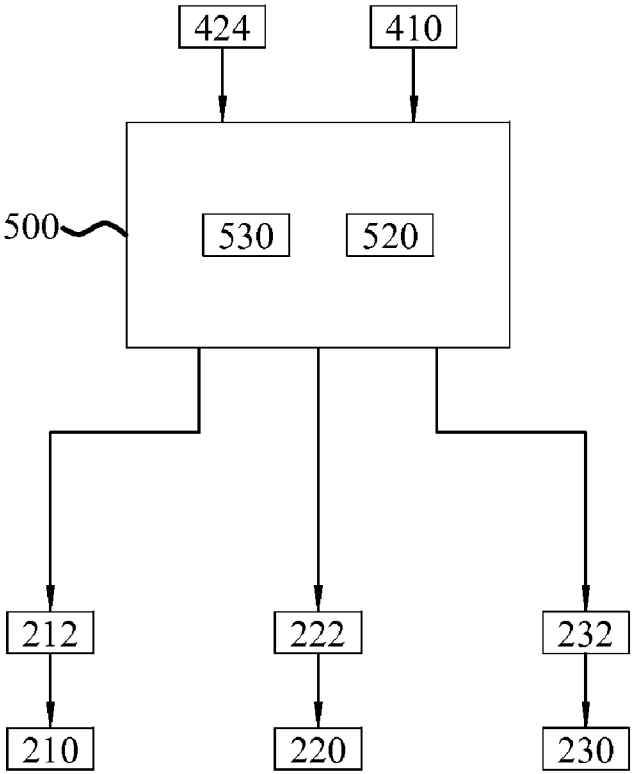
FIG. 6 is a block diagram illustrating an embodiment of fine-level operation of the boiler control system of the instant invention.

In another embodiment, the flue gas differential sensor (420) may be a flowrate sensor (424) to measure the flowrate of the flue gas, and the flue gas differential setpoint (530) may be a predetermined change in the flowrate of the flue gas, as seen in FIG. 6. The flowrate sensor (424) may be any type of flow sensing device, such as a pitot tube or a high temperature airflow measuring station. In operation, the flowrate sensor (424) will send output signals regarding the flue gas flowrate to the boiler controller (500), and if there is a change in the flue gas flowrate that meets the flue gas differential setpoint (530), the boiler controller (500) will send output signals to control the fine-level operation of the combustion air control system (200) or the fuel control system (300) to maintain the flue gas oxygen setpoint (520).

Figure 7:
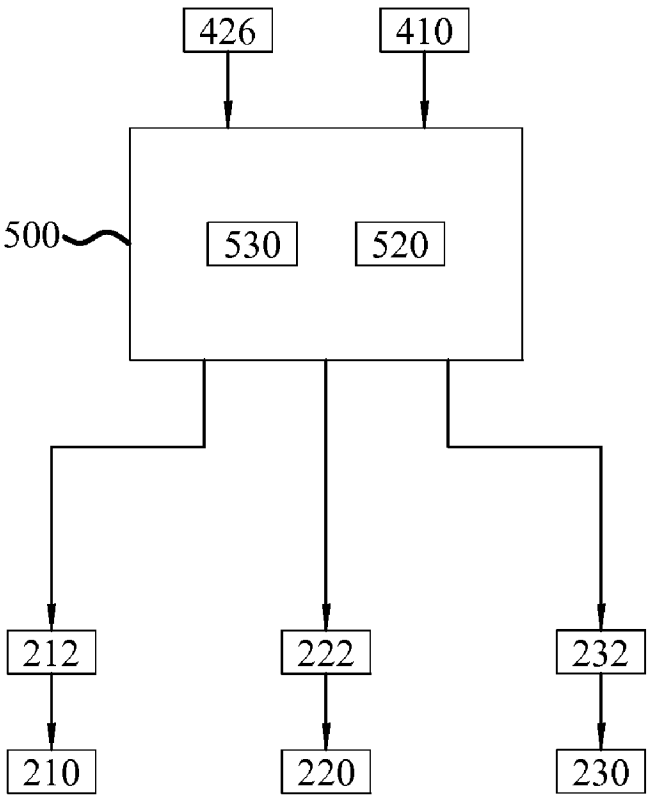
FIG. 7 is a block diagram illustrating an embodiment of fine-level operation of the boiler control system of the instant invention.

In yet another embodiment, the flue gas differential sensor (420) may be a pressure sensor (426) to measure the pressure of the flue gas, and the flue gas differential setpoint (530) may be a predetermined change in the flue gas pressure, as seen in FIG. 7. The pressure sensor (426) may be, for example, a piezoresistive pressure sensor, a MEMS pressure sensor, a vibrating element pressure sensor, or any other type of appropriate pressure sensing device. When the pressure sensor (426) is utilized, the pressure sensor (426) will send output signals relating to the flue gas pressure to the boiler controller (500). If there is a change in the flue gas pressure that meets the flue gas differential setpoint (530), the boiler controller (500) will send output signals to control the fine-level operation of the combustion air control system (200) or the fuel control system (300) to maintain the flue gas oxygen setpoint (520). The pressure sensor (426) may sense total pressure, velocity pressure, and/or static pressure. One skilled in the art is capable of selecting the specific type of pressure sensor (426) based upon the gas velocity in the stack; including, but not limited to, a manometer with pitot tube, a thermo-anemometer, and/or deflecting vane anemometer with pitot probe.

Figure 8:
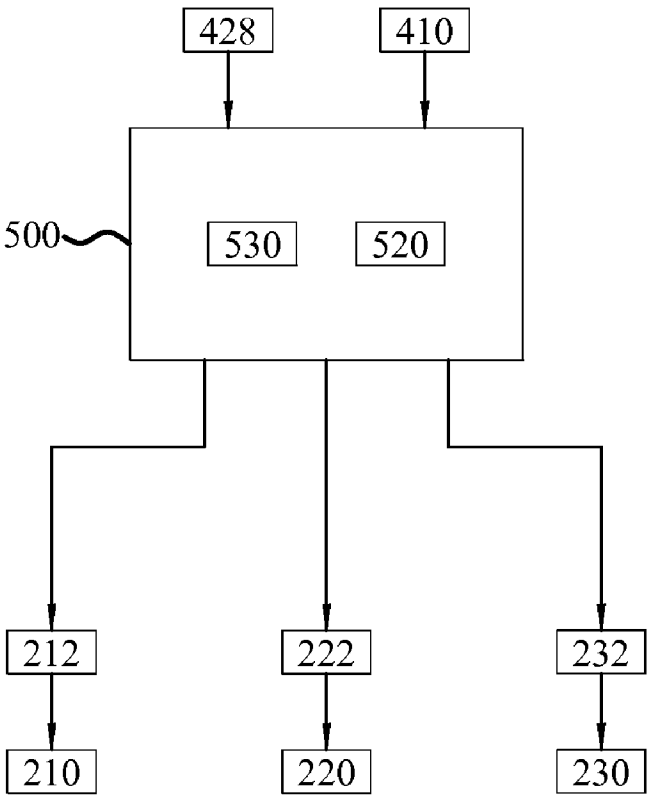
FIG. 8 is a block diagram illustrating an embodiment of fine-level operation of the boiler control system of the instant invention.

In still another embodiment, the flue gas differential sensor (420) may be a particulate sensor (428) to measure the amount of particulate in the flue gas, and the flue gas differential setpoint (530) may be a predetermined change in the amount of particulate in the flue gas, as seen in FIG. 8. The particulate sensor (428) may be, for example, an optical particulate sensor such as Optical Scientific's OFS-2000P™ Optical Flow/Particulate Sensor, an electrodynamic particulate sensor, or any other type of appropriate particulate sensing device. In operation, the particulate sensor (428) will send output signals regarding the amount of particulate in the flue gas to the boiler controller (500). If there is a change in the amount of particulate in the flue gas that meets the flue gas differential setpoint (530), the boiler controller (500) will send output signals to control the fine-level operation of the combustion air control system (200) or the fuel control system (300) to maintain the flue gas oxygen setpoint (520).

Additionally, in one embodiment, the boiler controller (500) may be programmed to control fine-level operation only when the change in a predetermined characteristic of the flue gas, as measured by the flue gas differential sensor (420), meets the flue gas differential setpoint (530) and is sustained for a certain amount of time. For example, the flue gas differential setpoint (530) may be set to a change in a predetermined characteristic of the flue gas (i.e., flue gas temperature, flue gas flowrate, flue gas pressure, or the amount of particulate in the flue gas) of at least 10%, and the change must be sustained for at least 10 seconds before fine-level operation will commence. This will ensure that the boiler (100) has reached a high degree of steady state operation after coarse-level control before any fine-level control adjustments are made, which thereby reduces "hunting" that is commonly experienced by prior art control systems. In one embodiment, a predetermined temperature change in flue gas temperature of at least 10% that is sustained for at least 10 seconds has been found to encompass an optimal variety of boiler types and boiler sizes. In an alternative embodiment utilizing flue gas flowrate as the predetermined characteristic, a predetermined flowrate change of at least 25% that is sustained for at least 10 seconds has been found to be particularly effective for a wide variety of boiler types and boiler sizes. Likewise, in an alternative embodiment utilizing flue gas pressure as the predetermined characteristic, a predetermined pressure change of at least 25% that is sustained for at least 10 seconds has been found to be particularly effective for a wide variety of boiler types and boiler sizes. Similarly, in an alternative embodiment utilizing flue particulate as the predetermined characteristic, a predetermined particulate change of at least 25% that is sustained for at least 10 seconds has been found to be particularly effective for a wide variety of boiler types and boiler sizes.

Adjustments to the fine-level operation of the combustion air control system (200) or the fuel control system (300) are controlled by the boiler controller (500) based on a comparison between the flue gas oxygen setpoint (520) and the amount of oxygen sensed in the flue gas by the oxygen sensor (410). As explained earlier, the amount of oxygen in the flue gas is related to the overall efficiency of the boiler (100), and substantial cost savings can be realized by closely controlling the amount of oxygen in the flue gas.

Figure 9:
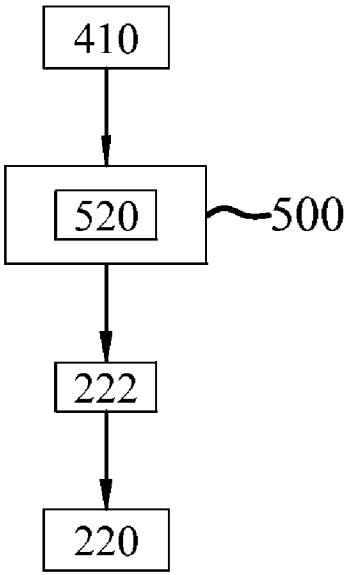
FIG. 9 is a block diagram illustrating an embodiment of fine-level operation of the boiler control system of the instant invention.

As seen FIG. 4, the fine-level operation of the combustion air control system (200) may be effected by several methods. For example, in one embodiment, the combustion air control system (200) may include a combustion air damper (220) to control the amount of combustion air supplied to the boiler (100) by the combustion air fan (210). The combustion air damper (220) may include a damper actuator (222) to control the fine-level operation of the combustion air damper (220), as depicted in FIG. 9. In operation, the oxygen sensor (410) will send output signals relating to the amount of oxygen in the flue gas to the boiler controller (500). Next, the boiler controller (500) will compare the amount of oxygen sensed by the oxygen sensor (410) to the flue gas oxygen setpoint (520). The boiler controller (500) will then communicate with the damper actuator (222) to control the fine-level operation of the combustion air damper (220) to adjust the amount of combustion air supplied to the boiler (100) so that the amount of oxygen in the flue gas will correspond to the flue gas oxygen setpoint (520).

Figure 10:
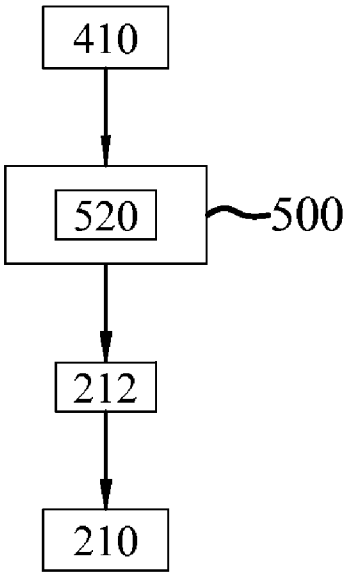
FIG. 10 is a block diagram illustrating an embodiment of fine-level operation of the boiler control system of the instant invention.

In another embodiment, the combustion air fan (210) may include a fan speed controller (212). The fan speed controller (212) may be used to vary the speed of the combustion air fan (210) in order to adjust the amount of combustion air that is supplied to the boiler (100) to control the amount of oxygen in the flue gas. When differences are observed between the information communicated to the boiler controller (500) by the oxygen sensor (410) and the flue gas oxygen setpoint (520), the boiler controller (500) will send output signals to the fan speed controller (212), as illustrated in FIG. 10. Based on the signals received from the boiler controller (500), the fan speed controller (212) will increase or decrease the speed of the combustion air fan (210) to supply an amount of combustion air that will tend to keep the amount of oxygen in the flue gas close to the flue gas oxygen setpoint (520).

Figure 11:
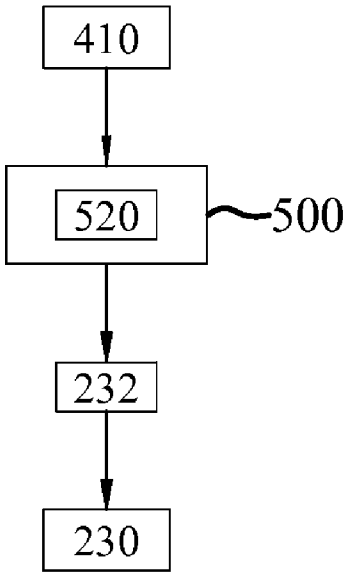
FIG. 11 is a block diagram illustrating an embodiment of fine-level operation of the boiler control system of the instant invention.

In yet another embodiment, the combustion air control system (200) may further include an auxiliary combustion air damper (230). The auxiliary combustion air damper (230) may include an auxiliary actuator (232) to control fine-level operation of the auxiliary combustion air damper (230). As seen in FIG. 11, the auxiliary actuator (232) is in operative communication with the boiler controller (500). As in the normal operation, the boiler controller (500) will determine that either more or less combustion air is needed to achieve a level of oxygen in the flue gas near the flue gas oxygen setpoint (520). Next, the boiler controller (500) will send output signals to the auxiliary actuator (232) based on the amount of combustion air required. In response to the signals received, the auxiliary actuator (232) will adjust the fine-level operation of the auxiliary combustion air damper (230) to supply an amount of combustion air that will tend to keep the amount of oxygen in the flue gas close to the flue gas oxygen setpoint (520). The auxiliary combustion air damper (230) and auxiliary actuator (232) may be designed and calibrated to make very fine adjustments that are not achievable using the standard combustion air damper (220) and actuator (222) supplied on most packaged boilers. In fact, in yet a further embodiment the auxiliary combustion air damper (230) is a precise slide damper coupled to a fine tuning auxiliary actuator (232); which in one embodiment may be a stepper motor with at least 1000 distinct control positions.

Although the combustion air damper (220), fan speed controller (212), and auxiliary combustion air damper (230) were described as separate embodiments, one with skill in the art would appreciate that the fine-level operation may be achieved using a combination of the elements. For example, fine-level operation of the combustion air control system (200) may be executed by using the combustion air damper (220) in combination with the fan speed controller (212). In fact, the combustion air damper (220), fan speed controller (212), and auxiliary combustion air damper (230) may all be used together for fine-level operation of the combustion air control system (200).

The combustion air control system (200), the flue gas sensing system (400), and the boiler controller (500) of the present invention may be part of an OEM packaged boiler, or may be part of an independent aftermarket boiler control system that functions independently from the OEM boiler system.

Numerous alterations, modifications, and variations of the embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

I claim:

1. A boiler control system for controlling the operation of a boiler (100), comprising:

A) a combustion air control system (200) including a combustion air fan (210) for supplying combustion air to the boiler (100) and a combustion air damper (220) for controlling the amount of combustion air supplied to the boiler (100) by the combustion air fan (210);

B) a fuel control system (300) including a burner (310) for supplying fuel to the boiler (100) and a fuel valve (320) for controlling the amount of fuel supplied to the boiler (100) by the burner (310);

C) a flue gas sensing system (400) including an oxygen sensor (410) and a flue gas differential sensor (420), wherein the oxygen sensor (410) senses the amount of oxygen in the flue gas leaving the boiler (100) and the flue gas differential sensor (420) senses a change in a predetermined characteristic of the flue gas associated with a change in the combustion air control system (200); and D) a boiler controller (500) having a system demand setpoint (510), a flue gas oxygen setpoint (520), and a flue gas differential setpoint (530), (i) wherein the boiler controller (500) is in operative communication with the combustion air control system (200), the fuel control system (300), and the flue gas sensing system (400), and (ii) wherein the boiler controller (500) controls coarse-level operation of the combustion air fan (210) and the fuel valve (320) based upon the system demand setpoint (510), and (iii) wherein when the flue gas differential sensor (420) has sensed a change in the flue gas predetermined characteristic that meets the flue gas differential setpoint (530) the boiler controller (500) controls the fine-level operation of the combustion air fan (210) to maintain the flue gas oxygen setpoint (520) based upon the amount of oxygen in the flue gas sensed by the oxygen sensor (410).

2. The boiler control system of claim 1, wherein the flue gas differential sensor (420) is a temperature sensor (422) measuring the temperature of the flue gas and the flue gas differential setpoint (530) is a predetermined change in flue gas temperature.

3. The boiler control system of claim 2, wherein the predetermined change in flue gas temperature is a temperature change of at least 10% and is sustained for at least 10 seconds before the flue gas oxygen level based fine-level operation of the combustion air fan (210) begins.

4. The boiler control system of claim 1, wherein the flue gas differential sensor (420) is a flowrate sensor (424) measuring the flowrate of the flue gas and the flue gas differential setpoint (530) is a predetermined change in flowrate of the flue gas.

5. The boiler control system of claim 4, wherein the predetermined change in flue gas flowrate is a flowrate change of at least 25% and is sustained for at least 10 seconds before the flue gas oxygen level based fine-level operation of the combustion air fan (210) begins.

6. The boiler control system of claim 1, wherein the flue gas differential sensor (420) is a pressure sensor (426) measuring the pressure of the flue gas and the flue gas differential setpoint (530) is a predetermined change in flue gas pressure.

7. The boiler control system of claim 6, wherein the predetermined change in flue gas pressure is a pressure change of at least 25% and is sustained for at least 10 seconds before the flue gas oxygen level based fine-level operation of the combustion air fan (210) begins.

8. The boiler control system of claim 1, wherein the flue gas differential sensor (420) is a particulate sensor (428) measuring the amount of particulate in the flue gas and the flue gas differential setpoint (530) is a predetermined change in amount of particulate in the flue gas.

9. The boiler control system of claim 1, wherein the combustion air fan (210) includes a fan speed controller (212) to vary the speed of the combustion air fan (210) to adjust the amount of combustion air supplied to the boiler (100) by the combustion air fan (210).

10. The boiler control system of claim 1, further including an auxiliary combustion air damper (230) to control the fine-level operation of the combustion air fan (210).

11. A boiler control system for controlling the operation of a boiler (100), comprising:

A) a combustion air control system (200) including a combustion air fan (210) for supplying combustion air to the boiler (100) and a combustion air damper (220) and an auxiliary combustion air damper (230) for controlling the amount of combustion air supplied to the boiler (100) by the combustion air fan (210);

B) a fuel control system (300) including a burner (310) for supplying fuel to the boiler (100) and a fuel valve (320) for controlling the amount of fuel supplied to the boiler (100) by the burner (310);

C) a flue gas sensing system (400) including an oxygen sensor (410) and a temperature sensor (422), wherein the oxygen sensor (410) senses the amount of oxygen in the flue gas leaving the boiler (100) and the temperature sensor (422) measures the temperature of the flue gas; and D) a boiler controller (500) having a system demand setpoint (510), a flue gas oxygen setpoint (520), and a flue gas differential setpoint (530) set at a 10% change in flue gas temperature, (i) wherein the boiler controller (500) is in operative communication with the combustion air control system (200), the fuel control system (300), and the flue gas sensing system (400), and (ii) wherein the boiler controller (500) controls coarse-level operation of the combustion air fan (210) and the fuel valve (320) based upon the system demand setpoint (510), and (iii) wherein when the temperature sensor (420) has sensed a change in flue gas temperature that meets the flue gas differential setpoint (530) and the change is sustained for at least 10 seconds, the boiler controller (500) communicates with the auxiliary combustion air damper (230) to control the fine-level operation of the combustion air fan (210) to maintain the flue gas oxygen setpoint (520) based upon the amount of oxygen in the flue gas sensed by the oxygen sensor (410).

12. A boiler control system for controlling the operation of a boiler (100), comprising:

A) a combustion air control system (200) including a combustion air fan (210) for supplying combustion air to the boiler (100) and a combustion air damper (220) and an auxiliary combustion air damper (230) for controlling the amount of combustion air supplied to the boiler (100) by the combustion air fan (210);

B) a fuel control system (300) including a burner (310) for supplying fuel to the boiler (100) and a fuel valve (320) for controlling the amount of fuel supplied to the boiler (100) by the burner (310);

C) a flue gas sensing system (400) including an oxygen sensor (410) and a flowrate sensor (424), wherein the oxygen sensor (410) senses the amount of oxygen in the flue gas leaving the boiler (100) and the flowrate sensor (422) measures the flowrate of the flue gas; and D) a boiler controller (500) having a system demand setpoint (510), a flue gas oxygen setpoint (520), and a flue gas differential setpoint (530) set at a 25% change in flue gas flowrate, (i) wherein the boiler controller (500) is in operative communication with the combustion air control system (200), the fuel control system (300), and the flue gas sensing system (400), and (ii) wherein the boiler controller (500) controls coarse-level operation of the combustion air fan (210) and the fuel valve (320) based upon the system demand setpoint (510), and (iii) wherein when the flowrate sensor (420) has sensed a change in flue gas flowrate that meets the flue gas differential setpoint (530) and the change is sustained for at least 10 seconds, the boiler controller (500) communicates with the auxiliary combustion air damper (230) to control the fine-level operation of the combustion air fan (210) to maintain the flue gas oxygen setpoint (520) based upon the amount of oxygen in the flue gas sensed by the oxygen sensor (410).

* * * * *